US007794619B2

(12) United States Patent
Kajiki et al.

(10) Patent No.: US 7,794,619 B2
(45) Date of Patent: Sep. 14, 2010

(54) REFRIGERATION LUBRICANT COMPOSITION AND REFRIGERANT WORKING FLUID COMPOSITION

(75) Inventors: Takeshi Kajiki, Amagasaki (JP); Naoya Maekawa, Amagasaki (JP)

(73) Assignee: NOF Corporation, Tokyo (JP)

( * ) Notice: Subject to any disclaimer, the term of this patent is extended or adjusted under 35 U.S.C. 154(b) by 0 days.

(21) Appl. No.: 12/057,124

(22) Filed: Mar. 27, 2008

(65) Prior Publication Data

US 2008/0237534 A1 Oct. 2, 2008

(30) Foreign Application Priority Data

Mar. 29, 2007 (JP) ..... 2007-088165
Feb. 26, 2008 (JP) ..... 2008-044812

(51) Int. Cl.
*C09K 5/04* (2006.01)
*C09K 5/00* (2006.01)
*C07C 49/00* (2006.01)

(52) U.S. Cl. ..... 252/68; 568/376; 568/579

(58) Field of Classification Search ..... 252/68, 252/45; 568/579, 584, 376
See application file for complete search history.

(56) References Cited

U.S. PATENT DOCUMENTS 4,792,411 A * 12/1988 Walsh ..... 508/308
5,575,944 A * 11/1996 Sawada et al. ..... 252/68
6,096,692 A 8/2000 Hagihara et al.
6,190,574 B1 2/2001 Nakagawa et al.
6,734,151 B1 5/2004 Kubota et al.

FOREIGN PATENT DOCUMENTS

| | | | |
|---|---|---|---|
| EP | 0435253 | A1 | 7/1991 |
| EP | 1227108 | A1 | 7/2002 |
| JP | 2915162 | * | 11/1992 |
| JP | 5-17789 | A | 1/1993 |
| JP | 8295892 | A | 11/1996 |
| JP | 11-150930 | A | 6/1999 |
| JP | 2000-32715 | A | 1/2000 |
| JP | 2002-57052 | A | 2/2002 |
| JP | 2003-17349 | A | 1/2003 |
| JP | 2003-61283 | A | 2/2003 |

OTHER PUBLICATIONS

Abstract JP4320498 esp@cenet: {http://v3.espacenet.com/publicationDetails/biblio?DB=EPODOC&adjacent=true&locale=en_EP&FT=D&date=19921111&CC=JP&NR=4320498A&KC=A}.*

* cited by examiner

*Primary Examiner*—Milton I Cano
*Assistant Examiner*—Aaron Greso
(74) *Attorney, Agent, or Firm*—Crompton, Seager & Tufte LLC

(57) ABSTRACT

A refrigeration lubricant composition contains an ester compound obtained from a polyol and a fatty acid, and a five- or six-membered ring cyclic ether compound having a side chain with an ester bonding. The content of the cyclic ether compound is adjusted to 0.01 to 5 parts by mass based on 100 parts by mass of the ester compound.

12 Claims, No Drawings

REFRIGERATION LUBRICANT COMPOSITION AND REFRIGERANT WORKING FLUID COMPOSITION

CROSS-REFERENCE TO RELATED APPLICATIONS

This application is based upon and claims the benefit of priority from the prior Japanese Patent Applications No. 2007-088165, filed on Mar. 29, 2007, and No. 2008-044812, filed on Feb. 26, 2008, the entire contents of which are incorporated herein by reference.

BACKGROUND OF THE INVENTION

The present disclosure relates to a refrigeration lubricant composition having excellent electrical insulation ability, excellent compatibility with chlorine-free hydrofluorocarbons, excellent heat resistance, and rustproof effects for rare earth magnets used in a refrigerating apparatus, and to a refrigerant working fluid composition employing such a refrigeration lubricant composition.

Conventional chlorofluorocarbon refrigerants which are used in room air conditioners, package air conditioners, low-temperature apparatuses such as refrigerator-freezers for home use, industrial refrigerators and automotive air conditioners such as hybrid cars and electric cars are being replaced because of problems, such as the ozone layer destruction. As the replacement chlorofluorocarbon refrigerants, chlorine-free hydrofluorocarbon refrigerants, such as 1,1,1,2-tetrafluoroethane (R-134a), pentafluoroethane (R-125), difluoroethane (R-32) and a mixture thereof, are known. Various refrigeration lubricants using a base stock containing a polyol type ester compound having high compatibility with chlorine-free hydrofluorocarbon refrigerants have been proposed. The properties required for the refrigeration lubricants include compatibility with chlorine-free hydrofluorocarbons, high electrical insulation ability and heat resistance. Patent Document 1 proposes a refrigeration lubricant containing a polyol type ester compound having high compatibility with chlorine-free hydrofluorocarbon refrigerants and high electrical insulation ability.

In recent years, social interest for energy conservation has been increasing, and it has been desired to reduce the power consumption of electrical products. In the case of refrigerators and air conditioners, it has been regarded as important to conserve the power of the compressor, which consumes a majority of the power of the refrigerators and air conditioners. In order to conserve the power of the compressors, a highly efficient compression mechanism has been developed, and at the same time, an increase in the efficiency of the motor in compression mechanisms has also been an important issue which would lead to power conservation of the entirety of the apparatuses.

In order to improve the efficiency of motors, more efficient and powerful magnets have been adopted for motors. For example, ferrite magnets have been positively replaced with rare earth magnets, and this contributes to a reduction in power consumption and size of electrical products. Neodymium magnets, such as Nd—Fe—B (neodymium-iron-boron), are relatively inexpensive examples of rare earth magnets. Refrigerant compressors using rare earth magnets have been proposed (see, for example, Patent Document 2). However, neodymium magnets have a low corrosion resistance and rust easily, and the magnet tends to deteriorate in quality. Deterioration of the rare earth magnets is a cause of lowering in the performance of the motor. Rust of the rare earth magnets is a cause of pipe clogging in the refrigerating cycles. Therefore, it is common to protect rare earth magnets with nickel plating or aluminum plating.

Patent Document 3 proposes a technique for protecting a rare earth magnet with a rustproof coating of sodium silicate glass instead of nickel plating in order to reduce costs. Patent Document 4 proposes a technique for protecting a rare earth magnet with a protective coating film in glass form, which is formed from a polysilazane coating film. Patent Document 5 proposes a technique for preventing rusting by carrying out heat treatment on a rare earth magnet in a low oxygen atmosphere. However, the conventional art is not suitable for motors for a refrigerant compressor which is exposed to a chlorine-free hydrofluorocarbon refrigerant or lubricant over many years. This is because under the conditions of use of the refrigerant compression motors, some components elute from the above described rustproof coating, glass-like protective coating, and heat treated film when used. This negatively affects properties of the refrigerant or the lubricant. In addition, a special technology, special equipments and special tasks are required for the manufacture of such rare earth magnets, and thus, the compressor is very disadvantageous in terms of the manufacturing costs.

Plating to a rare earth magnet lowers the magnetic flux content of the rare earth magnet. To avoid the plating process, Patent Document 6 proposes a manufacture method in which a motor having rare earth magnets is manufactured in an airtight environment with a low oxygen atmosphere. A special technology, special equipments and special tasks are also required for the technology described in Patent Document 6, and thus, the manufacture of an inexpensive compressor is difficult.

[Patent Document 1] Japanese Laid-open Patent Publication No. 5-17789

[Patent Document 2] Japanese Laid-open Patent Publication No. 11-150930

[Patent Document 3] Japanese Laid-open Patent Publication No. 2000-32715

[Patent Document 4] Japanese Laid-open Patent Publication No. 2003-17349

[Patent Document 5] Japanese Laid-open Patent Publication No. 2002-57052

[Patent Document 6] Japanese Laid-open Patent Publication No. 2003-61283

SUMMARY OF THE INVENTION

The refrigeration machine oil for a refrigerant of Patent Document 1 contains an ester oil synthesized from a multivalent alcohol and a monovalent fatty acid, the ester oil functioning as the main component. The refrigeration machine oil of Patent Document 1 has excellent compatibility with chlorine-free hydrofluorocarbons, electrical insulation ability and heat resistance. However, the ester oil cannot prevent ferrite magnets or neodymium type rare earth magnets from rusting. That is to say, the ester oil may adsorbed on metal surfaces due to ester bonding portions of the ester oil, however, this adsorption is weak, and in addition, the rigidity and the hydrophobicity are low, and therefore, the metal surfaces cannot be prevented from rusting. Accordingly, there is a need for a refrigeration lubricant composition that can provide satisfactorily rustproof effects without a special process such as a plating process or a coating process on the neodymium type rare earth magnets.

An object of the present invention is to provide a refrigeration lubricant composition having electrical insulation ability, compatibility with chlorine-free hydrofluorocarbons, heat resistance and effects of preventing rare earth magnets from rusting.

According to embodiments of the present invention, the following effects can be obtained.

A refrigeration lubricant composition according to one embodiment contains an ester compound obtained from a polyol and a fatty acid, and a five- or six-membered ring cyclic ether compound having a side chain with an ester bonding. The content of the above described cyclic ether compound is adjusted to 0.01 to 5 parts by mass based on 100 parts by mass of the ester compound. The cyclic ether compound does not have a charge within the molecule and is electrically neutral and it does not have highly-polar groups, such as a hydroxy group, an amino group or a carboxyl group. Therefore, it is considered not to lower the electrical insulation ability and heat resistance of the above described ester compound functioning as the base stock. In addition, the cyclic ether compound has an ester bonding within the molecule, and thus, has an affinity with chlorine-free hydrofluorocarbon refrigerants in which it is dissolved. The oxygen atom in the cyclic ether structure of the cyclic ether compound is restricted from rotating around the bonding due to the rigid cyclic structure, and thus, it is presumed that the cyclic ether compound is effectively adsorbed on the surface of the metal due to the lone-pair electrons and the ester bonding and can provide excellent rustproof effects due to the hydrophobicity of the alkyl group, which is introduced through the ester bonding.

Accordingly, the refrigeration lubricant composition according to the embodiment can maintain electrical insulation ability, compatibility with chlorine-free hydrofluorocarbons and heat resistance, and at the same time, provide excellent rustproof effects for the metal, such as the rare earth magnets, used in a refrigerating apparatus.

According to one embodiment of the refrigeration lubricant composition, the cyclic ether compound is a five- or six-membered ring cyclic acetal compound having a side chain with an ester bonding. Such a refrigeration lubricant composition has improved heat resistance.

According to one embodiment of the refrigeration lubricant composition, the cyclic acetal compound is represented by any of the following structural formulas (I) to (IV):

(I)

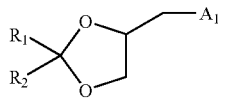

(II)

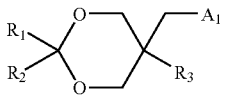

(III)

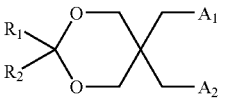

-continued (IV)

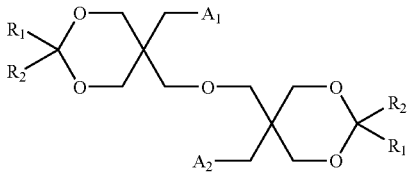

where $R_1$ and $R_2$ in the formulas each represent hydrogen or an alkyl group having 1 to 4 carbon atoms, $R_3$ represents an alkyl group having 1 or 2 carbon atoms, and $A_1$ and $A_2$ each represent an ester group represented by the formula (V) where $A_1$ and $A_2$ may be the same or different, and (V)

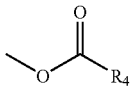

where $R_4$ represents an alkyl group having a straight or branched chain having 4 to 11 carbon atoms. Such a refrigeration lubricant composition can be prepared using an easily available cyclic acetal compound.

According to one embodiment of the refrigeration lubricant composition, the ester compound is an ester compound obtained from a neopentyl polyol that has 5 to 10 carbon atoms and 2 to 6 hydroxyl groups and a saturated aliphatic monocarboxylic acid having a straight or branched chain having 5 to 10 carbon atoms. Such a refrigeration lubricant composition can be prepared using an ester compound having excellent effects as the base stock.

According to one embodiment of the refrigeration lubricant composition, 60 mol % or higher of the saturated aliphatic monocarboxylic acid is a saturated aliphatic monocarboxylic acid having a branched chain. Such a refrigeration lubricant composition has improved compatibility with chlorine-free hydrofluorocarbons and hydrolysis resistance.

According to one embodiment of the refrigeration lubricant composition, the refrigeration lubricant composition is adapted to use in a refrigeration having a refrigerant compressor driven by a driving apparatus using a rare earth magnet. Such a refrigeration lubricant composition allows a refrigerating apparatus to be driven with high efficiency, and thus, contributes itself to energy conservation.

According to one embodiment, a refrigerant working fluid composition containing the above-described refrigeration lubricant composition and a chlorine-free hydrofluorocarbon refrigerant. Since the refrigeration lubricant composition has good compatibility with chlorine-free hydrofluorocarbons, the refrigerant working fluid can have the same effects and advantages of the refrigeration lubricant composition.

Other aspects and advantages of the present invention will become apparent from the following description, taken in conjunction with the accompanying drawings, illustrating by way of example the principles of the invention.

DESCRIPTION OF PREFERRED EMBODIMENTS

In the following, exemplary embodiments of the present invention are described.

The refrigeration lubricant composition according to an exemplary embodiment contains an ester compound obtained from a polyol and a fatty acid, and a five- or six-membered ring cyclic ether compound having a side chain with an ester bonding. The content of the cyclic ether compound is adjusted to 0.01 to 5 parts by mass based on 100 parts by mass of the ester compound.

The above described ester compound functions as the base stock of the refrigeration lubricant composition. Though the polyol constituting the ester compound is not particularly limited, it is preferable for it to be a neopentyl polyol having 5 to 10 carbon atoms and having 2 to 6 hydroxyl groups. This is an ester obtained from a saturated aliphatic monocarboxylic acid having a straight or branched chain having 5 to 10 carbon atoms. As the neopentyl polyol having 5 to 10 carbon atoms and having 2 to 6 hydroxyl groups, neopentyl glycol, trimethylolethane, trimethylolpropane, pentaerythrytol and dipentaerythrytol are preferable, and pentaerythrytol can be preferably used.

Meanwhile, though the fatty acid is not particularly limited, a saturated aliphatic monocarboxylic acid having a straight or branched chain having 5 to 10 carbon atoms is preferable. As the saturated aliphatic monocarboxylic acid having a straight or branched chain having 5 to 10 carbon atoms, pentanoic acid, hexanoic acid, heptanoic acid, octanoic acid, nonanoic acid, decanoic acid, 2-methyl pentanoic acid, 3-methyl pentanoic acid, 4-methyl pentanoic acid, 2,2-dimethyl butanoic acid, 2-ethyl butanoic acid, 3,3-dimethyl butanoic acid, 2,2-dimethyl pentanoic acid, 2-methyl-2-ethyl butanoic acid, 2,2,3-trimethyl butanoic acid, 2-methyl pentanoic acid, 3-ethyl pentanoic acid, 2-methyl hexanoic acid, 3-methyl hexanoic acid, 4-methyl hexanoic acid, 5-methyl hexanoic acid, isoheptanoic acid, 2 ethyl hexanoic acid, 3,5-dimethyl hexanoic acid, 2,2-dimethyl hexanoic acid, 2-methyl heptanoic acid, 3-methyl heptanoic acid, 4-methyl heptanoic acid, 2-propyl pentanoic acid, isooctanoic acid, 2,2-dimethyl heptanoic acid, 2,2,4,4-tetramethyl pentanoic acid, 3,5,5-trimethyl hexanoic acid, 2-methyl octanoic acid, 2-ethyl heptanoic acid, 3-methyl octanoic acid, isononanoic acid, neononanoic acid, 2,2-dimethyl octanoic acid, 2-methyl-2-ethyl heptanoic acid, 2-methyl-2-propyl hexanoic acid, isodecanoic acid, neodecanoic acid and the like can be used. These may be used alone or as a mixture of two or more thereof.

It is preferable for the ratio of the saturated aliphatic monocarboxylic acid having a branched chain to the entirety of the saturated aliphatic monocarboxylic acid to be 60 mol % or higher from the point of view of compatibility with chlorine-free hydrofluorocarbons and hydrolysis resistance. It is more preferable for it to be 80 mol % or higher, and it is most preferable for the entirety of the saturated aliphatic monocarboxylic acid to have a branched chain. As the saturated aliphatic monocarboxylic acid having a branched chain, 2-ethyl hexanoic acid or 3,5,5-trimethyl hexanoic acid is preferable.

It is preferable for the amounts of the above described polyol and fatty acid used to be adjusted so that the hydroxyl value of the obtained refrigeration lubricant composition be 10.0 mgKOH/g or less and the acid value be 0.1 mgKOH/g or less. It is preferable for the hydroxyl value to be 5.0 mgKOH/g or less, it is more preferable for it to be 2.0 mgKOH/g or less, and it is most preferable for it to be 1.0 mgKOH/g or less. In addition, the lower the acid value is, the more preferable it is, and it is preferable for it to be 0.05 mgKOH/g or less, and it is more preferable for it to be 0.02 mgKOH/g or less.

The ester compound can be prepared through a usual esterification reaction or an ester exchange reaction. Concretely, as the equivalent ratio of the above described polyol to fatty acid, it is usually preferable for the carboxyl group of the fatty acid to be 1.0 equivalent to 1.5 equivalents for one equivalent of the hydroxyl group of the polyol, and it is more preferable for it to be 1.05 equivalents to 1.3 equivalents from the points of view of the production and economical efficiencies. A catalyst is added for esterification reaction or ester exchange reaction if necessary. This mixture is placed in a nitrogen flow at 160° C. to 260° C. for 3 to 15 hours so that reaction occurs, and the excessive fatty acid is removed under reduced pressure at the point in time when the hydroxyl group value be 3.0 mgKOH/g or less. After that, the acid is removed using an alkali, and then, an adsorption process using activated white clay, acid clay or a synthesized adsorbent, a steaming process and the like are individually carried out or carried out in combination, and thus, the ester can be obtained.

The cyclic ether compound is a five- or six-membered ring compound having a side chain with an ester bonding. One example of the cyclic ether compound is a five- or six-membered ring cyclic acetal compound having a side chain with an ester bonding. Examples of the cyclic acetal compound include cyclic acetal compounds represented by the following structural formulas (I) to (IV).

(I)

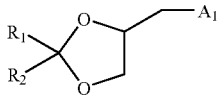

(II)

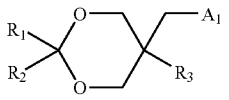

(III)

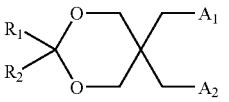

(IV)

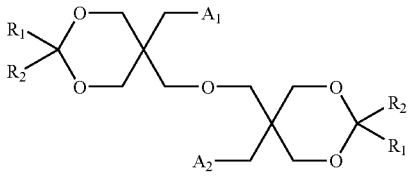

$R_1$ and $R_2$ in the formulas represent hydrogen or an alkyl group having 1 to 4 carbon atoms. $R_3$ represents an alkyl group having 1 or 2 carbon atoms. $A_1$ and $A_2$ respectively represent an ester group, as shown by the structural formula (V), and may be the same or different.)

(V)

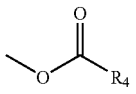

$R_4$ in the formula represents a straight chain or branched chain alkyl group having 4 to 11 carbon atoms.)

The cyclic acetal compounds having the structural formulas (I) to (IV) can be prepared through an esterification reaction between an alcohol which is prepared by acetalizing an aldehyde or ketone, as shown by the following formula (VI), using a multivalent alcohol having three or more hydroxyl groups within the molecule at a molar ratio of 1:1 or 2:1 and a monocarboxylic acid having a straight or branched chain alkyl group having 4 to 11 carbon atoms, preferably 6 to 11, as shown by $R_4$.

As the multivalent alcohol having three or more hydroxyl groups for the acetalization reaction, glycerin, trimethylolethane, trimethylolpropane, pentaerythrytol, dipentaerythrytol and the like can be used. In the case of the compound (VI), $R_1$ and $R_2$ are hydrogen or an alkyl group having 1 to 4 carbon atoms. If the number of carbon atoms in $R_1$ and $R_2$ further increases, rustproof effects for rare earth magnets may be insufficient. It is preferable for either $R_1$ or $R_2$ to be hydrogen, and it is more preferable for both $R_1$ and $R_2$ to be hydrogen.

(VI)

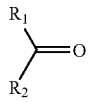

$R_1$ and $R_2$ in the formula are hydrogen or an alkyl group having 1 to 4 carbon atoms.

There are various methods for the acetalization reaction of these. An acid catalyst can be used in the acetalization reaction, such as hydrochloric acid, sulfuric acid, methane sulfonic acid, p-toluene sulfonic acid, an acid ion exchange resin or calcium chloride. Use of the acid catalyst can promote the acetalization reaction.

In order to provide excellent rustproof properties for rare earth magnets without affecting the electrical insulation ability, compatibility with chlorine-free hydrofluorocarbons or heat resistance of the polyol ester used in the refrigeration lubricant, it is preferable for the number of carbon atoms in the monocarboxylic acid having an alkyl group, as shown by $R_4$, to be 5 to 12. These saturated aliphatic monocarboxylic acids or saturated aliphatic monoalcohol have a straight or branched chain structure.

The cyclic ether compound can be prepared through an esterification reaction between an alcohol which is prepared by acetalizing an aldehyde or ketone compound having the structural formula (VI) using a multivalent alcohol having three or more hydroxyl groups and a monocarboxylic acid having an alkyl group of $R_4$. In this case, the esterification reaction is a general one where no catalyst, a Brønsted acid catalyst, such as hydrochloric acid, sulfuric acid, methane sulfonic acid, p-toluene sulfonic acid or an acid ion exchange resin, or a Lewis acid catalyst is used, and an appropriate refining process, such as a neutralization process using an alkaline solution or an adsorption process, is carried out. It is preferable for the cyclic ether compound synthesized in accordance with such a method to have an acid value of 1.0 mgKOH/g or lower and a hydroxyl value of 30 mgKOH/g or lower. In the case where the acid value exceeds 1.0 mgKOH/g, the refrigeration lubricant composition cannot provide excellent corrosion resistance. In addition, in the case where the hydroxyl value exceeds 30 mgKOH/g, the electrical insulation ability and hydrolysis resistance of the refrigeration lubricant composition deteriorate.

In addition, the content of the cyclic ether compound is 0.01 to 5 parts by mass relative to 100 parts by mass of the above described ester compound; it is preferable for it to be 0.02 parts by mass to 3 parts by mass, and it is more preferable for it to be 0.1 parts by mass to 1 mass part. In the case where this content is less than 0.01 parts by mass, the refrigeration lubricant composition cannot provide sufficient rustproof effects for rare earth magnets, and in the case where the content exceeds 5 parts by mass, further effects cannot be obtained, and in addition, the electrical insulation ability required for the refrigeration lubricant composition cannot be obtained.

A mixture of a chlorine-free hydrofluorocarbon refrigerant and the refrigeration lubricant composition can be used as a refrigerant working fluid composition that lubricates a refrigerating apparatus. Examples of the chlorine-free hydrofluorocarbon refrigerant include 1,1,1,2-tetrafluoroethane (R-134a), pentafluoroethane (R-125), difluoroethane (R-32), trifluoromethane (R-23), 1,1,2,2-tetrafluoroethane (R-134), 1,1,1-trifluoroethane (R-143a), 1,1-difluoroethane (R-152a) and the like. These may be used alone or as mixed refrigerants of two or more thereof.

Examples of the mixed refrigerants include R-407C(R-134a/R-125/R-32=52/25/23 wt %), R-410R(R-125/R-32=50/50 wt %), R-404A (R-125/R-143/R-134a=44/52/4 wt %), R-407E (R-134a/R-125/R-32=60/15/25 wt %), R-410B (R-32/R-125=45/55 wt %) and the like. Mixed refrigerants containing at least one of R-134a and R-32 are particularly preferable.

The mass ratio of the refrigeration lubricant composition to the chlorine-free hydrofluorocarbon refrigerant in the refrigerant working fluid composition is usually 10:90 to 90:10. In the case where the mass ratio of the chlorine-free hydrofluorocarbon refrigerant exceeds 90, the viscosity of the refrigerant working fluid composition lowers and which may lead to poor lubrication. Therefore, the mass ratio of the chlorine-free hydrofluorocarbon refrigerant is usually 90 or lower, and preferably 80 or lower. Meanwhile, in the case where the mass ratio of the chlorine-free hydrofluorocarbon refrigerant is less than 10, there is a risk that the refrigerating efficiency may lower.

Well-known additives, for example, antioxidants such as phenol type antioxidants; metal deactivators such as benzotriazole, thiadiazole and dithiocarbamate; acid supplying agents such as epoxy compound and carbodiimide; and additives such as phosphorous type extreme pressure agents and anti-wear agents, can be appropriately mixed in accordance with the purpose.

The refrigerant working fluid composition is appropriate for use in refrigerating apparatuses which have at least a compressor, a condenser, an expansion mechanism and an evaporator, and a dryer if necessary. More specifically, the refrigerant working fluid composition of the present invention is appropriate for use in refrigerant cooling apparatuses in air conditioners such as room air conditioners, package air conditioners and automotive air conditioners for hybrid cars and electric cars; refrigerators; and industrial refrigerators.

The exemplary embodiments have the following working effects.

The refrigeration lubricant compositions according to the representative embodiments include an ester compound obtained from a polyol and a fatty acid and a five- or six-membered ring cyclic ether compound having a side chain with an ester bonding where the content of the cyclic ether compound is set to 0.01 to 5 parts by mass based on 100 parts by mass of the ester compound. This cyclic ether compound does not have a charge within the molecule, is electrically neutral, and does not have highly-polar groups, such as a hydroxyl group, an amino group or a carboxyl group, and therefore, it is considered that the electrical insulation ability and heat resistance of the above described ester compound, which becomes the base stock, are not affected. In addition, the cyclic ether compound has an ester bonding within the molecule, and thus, has affinity and solubility for chlorine-free hydrofluorocarbon refrigerants. On top of this, in the cyclic ether compound, the free rotation of the oxygen atom in this cyclic ether structure around the bonding is restricted due to the rigid cyclic structure, and thus, it is presumed that the cyclic ether compound is effectively adsorbed on the metal surface due to its lone-pair electrons and ester bonding, and the hydrophobicity of the alkyl group which is introduced through the ester bonding provides excellent rustproof effects.

Accordingly, the refrigeration lubricant composition can maintain the electrical insulation ability, compatibility with chlorine-free hydrofluorocarbons and heat resistance, and at the same time, have excellent rustproof effects for metals of rare earth magnets used in the refrigerating apparatus. Therefore, sufficient rustproof effects, particularly for neodymium type rare earth magnets, can be provided without carrying out a specific process, such as a plating process and a coating process, and thus, the motor of the refrigerating apparatus can be operated with high efficiency.

The above described cyclic ether compound is a five- or six-membered ring cyclic acetal compound having a side chain with an ester bonding, and as a result, the heat resistance of the refrigeration lubricant composition can particularly be increased because of the chemical structure thereof.

The cyclic acetal compound is a compound represented by any of the above described structural formulas (I) to (IV), and thus, the cyclic acetal compound can be easily prepared.

The above described ester compound is an ester compound obtained from neopentyl polyol having 5 to 10 carbon atoms and having 2 to 6 hydroxyl groups, and a saturated aliphatic monocarboxylic acid having a straight or branched chain having 5 to 10 carbon atoms, and thus, the ester compound can have excellent effects as the base stock.

60 mol % or more of the saturated aliphatic monocarboxylic acid which forms the ester compound is a branched chain, and as a result, the compatibility with chlorine-free hydrofluorocarbons and the hydrolysis resistance can be improved.

The above described refrigerating apparatus is provided with a refrigerant compressor which is driven by a drive apparatus where rare earth magnets are used, and therefore, the effects of the above described refrigeration lubricant composition can be provided in the refrigerant compressor so that the refrigerating apparatus can be driven with high efficiency and power consumption can be reduced.

The refrigerant working fluid composition is a composition containing the above descried refrigeration lubricant composition, and a chlorine-free hydrofluorocarbon refrigerant, and therefore, the refrigeration lubricant composition is highly compatible with the chlorine-free hydrofluorocarbon refrigerant and can sufficiently provide the effects.

EXAMPLES

In the following, synthesis examples, examples and comparative examples are described. The present invention is not limited to the examples.

Synthesis Example 1

Synthesis of Ester Compounds A to H

Materials were charged into a 1 L four-neck flask provided with a thermometer, a nitrogen inlet tube, a stirrer, and a dehydrating column with a condenser so that the ratio of the hydroxyl group and the carboxyl group is 1:1.1 in the equivalent ratio, and then, an ester obtained from a polyol and a fatty acid, as shown in Table 1, was synthesized. Concretely, the materials were held under a nitrogen flow at 160° C. for six hours, and after that, reacted under atmospheric pressure while the water resulting from the reaction was being removed at 220° C. by distillation. At the point when the hydroxyl value became 2.0 mgKOH/g or lower, the reaction was terminated and the unreacted fatty acid was removed under a reduced pressure of 1 kPa to 5 kPa over one hour. After that, a potassium hydroxide solution was added to neutralize the resultant reaction mixture. The resultant ester compound was washed with water five times and dehydrated under a reduced pressure of 1 kPa at 100° C., and an acid white clay and a silica-alumina type adsorbent were added thereto such that each of them was contained 1.0 mass % of the theoretical amount needed for the ester to be obtained for an adsorption process. The temperature, the pressure and the time for the adsorption process were 100° C., 1 kPa and 3 hours, respectively. Finally, the mixture was filtrated using a filter of 1 micron (μm), and thus an ester was obtained. In this manner, each of ester compounds A to H was prepared.

The kinematic viscosity, the color number, the acid value and the hydroxyl value of these ester compounds were measured in accordance with the following methods for measurement, and the results are shown in Table 1.

Kinematic viscosity at 40° C. and 100° C.: measured in accordance with JIS K-2283

Color number: measured in accordance with JOCS 2.2.1.4-1996

Acid value: measured in accordance with JIS C-2101

Hydroxyl value: measured in accordance with JIS K-0070

TABLE 1

| Ester compound | Polyol (mol %) | Fatty acid (mol %) | Kinematic viscosity ($mm^2/s$) 40° C. | Kinematic viscosity ($mm^2/s$) 100° C. | Color number (APHA) | Acid value (mgKOH/g) | Hydroxyl value (mgKOH/g) |
|---|---|---|---|---|---|---|---|
| A | NPG(100) | 2-ethyl hexanoic acid (100) | 7.48 | 2.05 | 40 | 0.01< | 1.1 |
| B | NPG(60) PE(40) | 2-ethyl hexanoic acid (100) | 14.6 | 3.10 | 55 | 0.01< | 0.5 |
| C | TMP(100) | 2-methyl hexanoic acid (75) 3,5,5-trimethyl hexanoic acid (25) | 19.3 | 3.82 | 62 | 0.01< | 1.3 |
| D | PE(100) | 2-ethyl hexanoic acid (55) 3,5,5-trimethyl hexanoic acid (45) | 83.6 | 9.70 | 58 | 0.01< | 2.0 |
| E | PE(100) | 2-ethyl hexanoic acid (35) 3,5,5-trimethyl hexanoic acid (65) | 97.6 | 10.60 | 65 | 0.01< | 0.8 |
| F | PE(100) | n-pentanoic acid (20) 3,5,5-trimethyl hexanoic acid (80) | 89.5 | 10.20 | 69 | 0.01< | 1.5 |

TABLE 1-continued

| Ester compound | Polyol (mol %) | Fatty acid (mol %) | Kinematic viscosity ($mm^2/s$) 40° C. | 100° C. | Color number (APHA) | Acid value (mgKOH/g) | Hydroxyl value (mgKOH/g) |
|---|---|---|---|---|---|---|---|
| G | PE(90) diPE(10) | n-pentanoic acid (20) n-heptanoic acid (15) 3,5,5-trimethyl hexanoic acid (65) | 60.5 | 7.63 | 110 | 0.01< | 1.2 |
| H | PE(100) | 2-methyl hexanoic acid (70) n-octanoic acid (30) | 26.3 | 5.01 | 70 | 0.01< | 1.8 |

NPG: neopentyl glycol
PE: pentaerythrytol
TMP: trimethylolpropane
diPE: dipentaerythrytol

Synthesis Example 2

Synthesis of Cyclic Acetal Compounds 1 to 5

Table 2 shows cyclic acetal compounds 1 to 5 in Synthesis Example 2. The cyclic acetal compounds 1 to 5 are examples of cyclic ether having side chain with ester bonding. The acetal compounds in the comparative synthesis example, which is used for comparison with the cyclic acetal compounds 1 to 5 in Synthesis Example 2, are represented by the chemical formula (VII) and the chemical formula (VIII). The cyclic acetal compound of chemical formula (VII) does not have an ester bonding in the side chain. The cyclic acetal compound of chemical formula (VIII) is not a cyclic acetal compound. In Table 3, the cyclic acetal compounds of chemical formulas (VII) and (VIII) are denoted as ether compounds 9 and 10, respectively. The cyclic acetal compounds were synthesized as follows.

(VII)

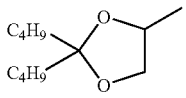

(VIII)

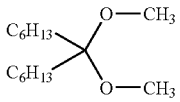

Synthesis of Cyclic Acetal Compound 1

Glycerin (250 g), acetone (522 g) and 800 mL of toluene were charged into a 2 L four-neck flask to which a thermometer, a nitrogen inlet tube, a stirrer and a dehydrating column with a condenser were attached, and then, methane sulfonic acid (26 g) was added thereto and refluxed for 30 hours while removing the distilled water. Next, a potassium hydroxide solution was added to neutralize the reaction mixture. The reaction product was washed with ion exchanged water five times, and after that, the toluene was distilled off under reduced pressure, and thus, 298 g of 4-hydroxymethyl-2,2-dimethyl-1,3-dioxolan was obtained.

The obtained 298 g of 4-hydroxymethyl-2,2-dimethyl-1,3-dioxolan was charged into a 1 L four-neck flask to which a thermometer, a nitrogen inlet tube, a stirrer and a dehydrating column with a condenser were attached, and 392 g of 3,5,5-trimethylhexanoic acid was added thereto, and the same operation as for the method of Synthesis of Ester Compounds A to H was carried out, and thus, 491 g of cyclic acetal compound 1 was obtained. The acid value of the obtained cyclic acetal compound 1 was 0.1 mgKOH/g and the hydroxyl value was 6 mgKOH/g.

Syntheses of Cyclic Acetal Compounds 2 to 8

Cyclic acetal compounds 2 to 8, shown in Table 2, were synthesized through the same operation as for the annual acetal compound 1. The acid value of the prepared cyclic acetal compound 2 was 0.1 mgKOH/g and the hydroxyl value was 5 mgKOH/g. The acid value of the cyclic acetal compound 3 was 0.1 mgKOH/g and the hydroxyl value was 3 mgKOH/g. The acid value of the cyclic acetal compound 4 was 0.1 mgKOH/g and the hydroxyl value was 2 mgKOH/g. The acid value of the cyclic acetal compound 5 was 0.2 mgKOH/g and the hydroxyl value was 8 mgKOH/g. The acid value of the cyclic acetal compound 6 was 0.1 mgKOH/g and the hydroxyl value was 2 mgKOH/g. The acid values of the cyclic acetal compounds 7 and 8 were 0.2 mgKOH/g and the hydroxyl value were 3 mgKOH/g.

TABLE 2

| | Structural formula | $R_1$ | $R_2$ | $R_3$ | $R_4$ |
|---|---|---|---|---|---|
| 1 | (I) | $CH_3$— | $CH_3$— | — | —$CH_2CH(CH_3)CH_2C(CH_3)_3$ (100) |
| 2 | (II) | $CH_3CH_2CH_2CH_2$— | H— | $C_2H_5$— | —$CH(C_2H_5)CH_2CH_2CH_2CH_3$ (50) —$(CH_2)_{10}CH_3$ (50) |
| 3 | (III) | $CH_3$— | $C_2H_5$— | — | —$(CH_2)_5CH_3$ (30) —$CH(C_2H_5)CH_2CH_2CH_2CH_3$ (70) |
| 4 | (III) | H— | H— | — | —$CH(C_2H_5)CH_2CH_2CH_2CH_3$ (55) |

TABLE 2-continued

| Structural formula | $R_1$ | $R_2$ | $R_3$ | $R_4$ |
|---|---|---|---|---|
| | | | | —$CH_2CH(CH_3)CH_2C(CH_3)_3$ (45) |
| (IV) | $CH_3$— | $CH_3$— | — | —$CH(C_2H_5)CH_2CH_2CH_2CH_3$ (100) |
| (I) | H— | H— | — | —$CH_2CH(CH_3)CH_2C(CH_3)_3$ (100) |
| (II) | H— | H— | $C_2H_5$— | —$(CH_2)_4CH_3$ (30) —$CH(C_2H_5)CH_2CH_2CH_2CH_3$ (70) |
| (IV) | H— | H— | — | —$(CH_2)_3CH_3$ (20) —$CH(C_2H_5)CH_2CH_3$ (80) |

The bracketed values in FIG. 2 each represent mol % of the subjected group in the respective alkyl group $R_4$.

Examples 1 to 17 and Comparative Examples 1 to 5

In Examples 1 to 17 and Comparative Examples 1 to 5, the ester compounds of Synthesis Example 1 and the cyclic ether compounds of synthesis example 2 were mixed in the compositions shown in Table 3 to prepare refrigeration lubricant compositions. Comparative Examples 1 to 3 employ ethers outside the scope of the present invention. In Comparative Examples 4 and 5, the cyclic ether compound content in the ester compounds was outside the scope of the present invention.

The volume resistivity and the two-phase separation temperature (temperature at which two separate layers are created) in the prepared refrigeration lubricant compositions were measured, and a sealed tube test was conducted in accordance with the following methods, and the results are shown in Table 4.

Volume resistivity: The volume resistivity (Ω·cm) at 25° C. was measured in accordance with JIS C-2101.

Two-phase separation temperature: 0.5 g of each sample and 2.5 g of refrigerant R-134a or R-407C were sealed in a thick Pyrex tube (length: 300 mm, outer diameter: 10 mm, inner diameter: 6 mm) which was cooled in an ethanol bath in which dry ice was charged, and heated or cooled at a rate of 1° C./min. Then, the two-phase separation temperature (° C.) at a high temperature and a low temperature in a range from −50° C. to 80° C. was visually measured.

Sealed tube test: 2 g of each sample of which the water content was adjusted to approximately 100 ppm in advance, 3 g of refrigerant R-134a and 1 metal piece each of iron, copper and aluminum having a length of 10 mm were sealed in thick Pyrex tubes (length: 300 mm, outer diameter: 10 mm, inner diameter: 6 mm). Each tube was heated for 14 days at 175° C., and the seal was opened and the refrigerant was taken out. Change in the metal pieces and the appearance of the sample was visually observed, and in addition, the acid value (mgKOH/g) was measured.

TABLE 3

| | | Example | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Ester compound (parts by mass) | A | 100 | 20 | — | — | 20 | — | — | — | — | — | 40 | — |
| | B | — | 80 | — | — | — | — | 30 | 45 | — | — | — | — |
| | C | — | — | 100 | — | — | — | — | — | — | 60 | — | — |
| | D | — | — | — | 100 | — | — | — | — | 50 | — | — | — |
| | E | — | — | — | — | 80 | 100 | 70 | 45 | — | — | — | — |
| | F | — | — | — | — | — | — | — | 10 | 50 | — | — | 50 |
| | G | | | | | | | | | | 40 | | |
| | H | — | — | — | — | — | — | — | — | — | — | 60 | 50 |
| Cyclic ether compound (parts by mass) | 1 | — | 0.2 | — | — | — | — | 0.3 | — | — | — | — | 0.5 |
| | 2 | 2.0 | — | — | 0.5 | — | — | — | — | 3.0 | — | — | — |
| | 3 | — | — | — | — | 1.5 | — | — | 1.5 | — | — | — | — |
| | 4 | — | — | 0.3 | 0.1 | — | 0.1 | — | — | — | — | 0.05 | — |
| | 5 | — | — | — | — | — | — | 1.0 | — | — | 0.3 | — | 0.5 |
| | 6 | — | — | — | — | — | — | — | — | — | — | — | — |
| | 7 | — | — | — | — | — | — | — | — | — | — | — | — |
| | 8 | — | — | — | — | — | — | — | — | — | — | — | — |
| Ether compound (parts by mass) | 9 | — | — | — | — | — | — | — | — | — | — | — | — |
| | 10 | — | — | — | — | — | — | — | — | — | — | — | — |

TABLE 3-continued

| | | Example | | | | | Comparative Example | | | | |
|---|---|---|---|---|---|---|---|---|---|---|---|
| | | 13 | 14 | 15 | 16 | 17 | 1 | 2 | 3 | 4 | 5 |
| Ester compound (parts by mass) | A | — | — | — | — | — | 50 | — | 20 | — | — |
| | B | — | — | — | 100 | — | — | — | — | — | — |
| | C | — | — | — | — | — | 50 | — | — | — | 30 |
| | D | — | 80 | — | — | 100 | — | 40 | — | — | — |
| | E | — | — | 50 | — | — | — | — | — | 100 | — |
| | F | 100 | — | — | — | — | — | — | — | — | — |
| | G | | 20 | 50 | | | | 60 | | | 70 |
| | H | — | — | — | — | — | — | — | 80 | — | — |
| Cyclic ether compound (parts by mass) | 1 | — | — | — | — | 5.0 | — | — | — | — | 0.005 |
| | 2 | — | 0.3 | — | — | — | — | — | — | 10 | — |
| | 3 | — | — | — | — | — | — | — | — | — | — |
| | 4 | — | — | — | 0.01 | — | — | — | — | — | — |
| | 5 | — | — | — | — | — | — | — | — | — | — |
| | 6 | 0.2 | — | — | — | — | — | — | — | — | — |
| | 7 | — | 1.0 | — | — | — | — | — | — | — | — |
| | 8 | — | — | 1.0 | — | — | — | — | — | — | — |
| Ether compound (parts by mass) | 9 | — | — | — | — | — | 5.0 | — | 3.0 | — | — |
| | 10 | — | — | — | — | — | — | 5.0 | 2.0 | — | — |

TABLE 4

| | | | Two-phase separation temperature | | | | |
|---|---|---|---|---|---|---|---|
| | | | R-134a | | R-407C | Sealed tube test | |
| | | Volume Resistivity ($\times 10^{13}\ \Omega \cdot$ cm) | Low temp (° C.) | High temp (° C.) | Low temp (° C.) | Appearance of metal | Acid value (mg KOH/g) |
| Example | 1 | 8.0 | <−50 | 80< | <−50 | No change | 0.03 |
| | 2 | 23.0 | −38 | 80< | −29 | No change | 0.03 |
| | 3 | 48.0 | −35 | 80< | −27 | No change | 0.04 |
| | 4 | 55.0 | −20 | 80< | −10 | No change | 0.05 |
| | 5 | 46.0 | −32 | 80< | −25 | No change | 0.05 |
| | 6 | 60.0 | −25 | 80< | −16 | No change | 0.05 |
| | 7 | 50.0 | −23 | 80< | −18 | No change | 0.04 |
| | 8 | 38.0 | −26 | 80< | −20 | No change | 0.04 |
| | 9 | 37.0 | −29 | 80< | −21 | No change | 0.07 |
| | 10 | 46.0 | −37 | 80< | −30 | No change | 0.06 |
| | 11 | 20.0 | −40 | 80< | −31 | No change | 0.07 |
| | 12 | 30.0 | −30 | 80< | −22 | No change | 0.09 |
| | 13 | 30.0 | −40 | 80< | −32 | No change | 0.09 |
| | 14 | 52.0 | −28 | 80< | −18 | No change | 0.08 |
| | 15 | 32.5 | −48 | 80< | −38 | No change | 0.04 |
| | 16 | 25.0 | −30 | 80< | −21 | No change | 0.03 |
| | 17 | 20.0 | −15 | 80< | −8 | No change | 0.07 |
| Comparative Example | 1 | 22.0 | −48 | 80< | −44 | No change | 0.04 |
| | 2 | 32.0 | −30 | 80< | −37 | No change | 0.08 |
| | 3 | 20.0 | −25 | 80< | −22 | No change | 0.08 |
| | 4 | 1.0 | −5 | 80< | 0 | No change | 0.10 |
| | 5 | 43.0 | −38.5 | 80< | −30 | No change | 0.08 |

It can be seen from the results shown in Table 4 that the volume resistivity, that is to say, the electrical insulation ability, and the compatibility with chlorine-free hydrofluorocarbons at a low temperature were significantly lowered in Comparative Example 4, where the cyclic ether compound content was excessive. The volume resistivity, the two-phase separation temperature and the results of the sealed tube test were all excellent in the other examples; that is, Examples 1 to 17 and Comparative Examples 1 to 3 and 5.

Next, a chlorine-free hydrofluorocarbon refrigerant was mixed into the above described refrigeration lubricant compositions so that refrigerant working fluid compositions were prepared, and the following rustproof test for a rare earth magnet was conducted for these refrigeration fluid compositions. The results are shown in Table 5.

Rustproof Test 2.0 g of each sample of which the water content was adjusted to approximately 1000 ppm in advance, 3.0 g of refrigerant R-134a, an uncoated test piece of NEOMAX-39SH (neodymium-iron-boron type rare earth magnet, outer diameter: 5 mm, length: 50 mm) available from NEOMAX Co., Ltd., and metal pieces made of Fe, Cu, and Al were charged in glass tubes which were then sealed. Each tube was heated for 14 days at 175° C., and the seal was opened and the refrigerant was taken out. Change in the test piece of a rare earth magnet was visually observed. In the case where corrosion, however slight, was visually recognized in the rare earth magnet, the evaluation was "X." In the case where color change to blackish brown was recognized in, the evaluation was "○." In the case where no change was recognized in the rare earth magnet, the evaluation was "◎."

TABLE 5

| | | Appearance of test piece |
|---|---|---|
| Example | 1 | ○ |
| | 2 | ○ |
| | 3 | ◎ |
| | 4 | ◎ |
| | 5 | ○ |
| | 6 | ◎ |
| | 7 | ○ |
| | 8 | ○ |
| | 9 | ○ |
| | 10 | ○ |
| | 11 | ◎ |
| | 12 | ○ |
| | 13 | ◎ |
| | 14 | ◎ |
| | 15 | ◎ |
| | 16 | ○ |
| | 17 | ◎ |
| Comparative Example | 1 | X |
| | 2 | X |
| | 3 | X |
| | 4 | ◎ |
| | 5 | X |

It can be seen from the results shown in Table 5 that no rust was recognized in Examples 1 to 17 and Comparative Example 4, and thus, the rare earth magnet was effectively prevented from rusting. On the other hand, in Comparative Examples 1 to 3 and 5, the ether compound used was a compound which falls outside the scope of the present invention, or the cyclic ether compound content in the ester compound was too small, and as a result, rust was not prevented, and rust was clearly recognized.

The exemplary embodiments may be modified as follows.

In the examples, a compound, which has 4 to 6 carbon atoms and except for the cyclic acetal compounds 7 and 8, can be used for $R_4$ in the cyclic acetal compound represented by the structural formula (V).

In the above described examples, R-125, R-32 or the like can be used as the chlorine-free hydrofluorocarbon refrigerant.

It is also possible to mix a compound which increases the compatibility between the above described ester compound and cyclic ether compound into the refrigerant working fluid composition.

It is also possible to mix a lubricant, such as a mineral oil or a synthetic oil into the refrigerant working fluid composition.

Four or more kinds of the ester compounds can be compounded in the refrigeration lubricant composition, and three or more kinds of the cyclic ether compounds can be compounded in the refrigeration lubricant composition.

Compounds for improving compatibility with chlorine-free hydrofluorocarbons can be additionally used with the ester compound and the cyclic ether compound constituting the refrigeration lubricant composition.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A refrigeration lubricant composition, comprising:

a polyol-fatty acid ester compound which is a reaction product obtained from a polyol and a fatty acid; and a five- or six-membered ring cyclic acetal compound represented by any of the following structural formulas (I) to (IV):

(I)

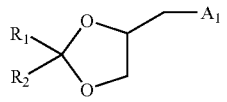

(II)

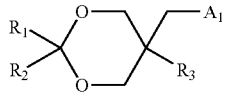

(III)

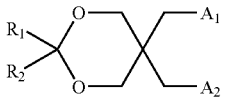

(IV)

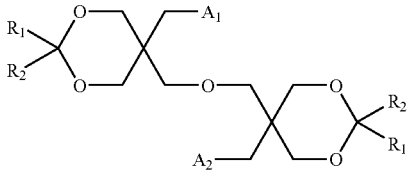

where $R_1$ and $R_2$ in the formulas each represent hydrogen, $R_3$ represents an alkyl group having 1 or 2 carbon atoms, and $A_1$ and $A_2$ each represent an ester group represented by the formula (V) where $A_1$ and $A_2$ are the same or different, and (V)

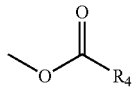

where $R_4$ represents an alkyl group having a straight or branched chain having 4 to 11 carbon atoms, wherein the content of the cyclic acetal compound is 0.01 to 5 parts by mass based on 100 parts by mass of the polyol-fatty acid ester compound, and wherein the refrigeration lubricant composition is adapted to use with a drive apparatus having rare earth magnets and a refrigerant compressor which is driven by the drive apparatus to compress a refrigerant.

2. The refrigeration lubricant composition according to claim 1, wherein the cyclic acetal compound is a five-membered ring cyclic acetal compound represented by the structural formula (I).

3. The refrigeration lubricant composition according to claim 1, wherein the polyol-fatty acid ester compound is a reaction product obtained from a neopentyl polyol that has 5 to 10 carbon atoms and 2 to 6 hydroxyl groups and a saturated aliphatic monocarboxylic acid having a straight or branched chain having 5 to 10 carbon atoms.

4. The refrigeration lubricant composition according to claim 3, wherein 60 mol % or higher of the saturated aliphatic monocarboxylic acid is a saturated aliphatic monocarboxylic acid having a branched chain.

5. The refrigeration lubricant composition according to claim 1, wherein the cyclic acetal compound is a 6-membered ring cyclic acetal compound represented by any one of the structural formulas (II) to (IV).

6. The refrigeration lubricant composition according to claim 1, wherein the cyclic acetal compound is a cyclic acetal compound represented by the structural formula (III).

7. The refrigeration lubricant composition according to claim 3, wherein the neopentyl polyol is neopentyl glycol, trimethylolethane, trimethylolpropane, pentaerythrytol or dipentaerythrytol.

8. The refrigeration lubricant composition according to claim 3, wherein the saturated aliphatic monocarboxylic acid having a straight or branched chain is selected from the group consisting of 2-methyl hexanoic acid, 2-ethylhexanoic acid, 3,5,5-trimethylhexanoic acid, pentanoic acid, heptanoic acid, and octanoic acid.

9. The refrigeration lubricant composition according to claim 3, wherein the saturated aliphatic monocarboxylic acid having a branched chain is 2-ethylhexanoic acid or 3,5,5-trimethylhexanoic acid.

10. The refrigeration lubricant composition according to claim 1, which has an acid value of 0.1 mgKOH/g or less and a hydroxyl value of 10.0 mgKOH/g or less.

11. The refrigeration lubricant composition according to claim 1, wherein the cyclic acetal compound has an acid value of 1.0 mgKOH/g or less and a hydroxyl value of 30.0 mgKOH/g or less.

12. A refrigerant working fluid composition containing the refrigeration lubricant composition of claim 1 and a chlorine-free hydrofluorocarbon refrigerant.

* * * * *